US011342719B2

(12) United States Patent
Riner et al.

(10) Patent No.: US 11,342,719 B2
(45) Date of Patent: May 24, 2022

(54) FREESTANDING ELECTRICAL RECEPTACLE

(71) Applicant: Group Dekko, Inc., Fort Wayne, IN (US)

(72) Inventors: Raymond H. Riner, Fort Wayne, IN (US); Austin S. Valley, Grand Rapids, MI (US)

(73) Assignee: Group Dekko, Inc., Fort Wayne, IN (US)

( * ) Notice: Subject to any disclaimer, the term of this patent is extended or adjusted under 35 U.S.C. 154(b) by 16 days.

(21) Appl. No.: 17/027,832

(22) Filed: Sep. 22, 2020

(65) Prior Publication Data

US 2022/0094121 A1 Mar. 24, 2022

(51) Int. Cl.
*H01R 24/76* (2011.01)
*H01R 13/46* (2006.01)

(52) U.S. Cl.
CPC ..... *H01R 24/76* (2013.01); *H01R 13/46* (2013.01)

(58) Field of Classification Search
CPC ..... H01R 24/76; H01R 13/46; H01R 25/003; H01R 24/20
See application file for complete search history.

(56) References Cited

U.S. PATENT DOCUMENTS

| | | | | |
|---|---|---|---|---|
| 6,752,653 | B1 * | 6/2004 | Morlock | H01R 25/003 439/216 |
| 9,635,773 | B1 * | 4/2017 | Marshall | H01R 27/02 |
| 10,944,208 | B1 * | 3/2021 | Lamusga | H01R 13/60 |
| 2016/0226279 | A1 * | 8/2016 | Anderson | H02J 7/0045 |
| 2019/0044295 | A1 * | 2/2019 | Wei | H01R 35/04 |

FOREIGN PATENT DOCUMENTS

| | | | | |
|---|---|---|---|---|
| FR | 2960352 | A1 * | 11/2011 | H01R 25/003 |
| KR | 20110079944 | A * | 7/2011 | H01R 25/003 |

* cited by examiner

*Primary Examiner* — Tho D Ta
(74) *Attorney, Agent, or Firm* — Taylor IP, P.C.

(57) ABSTRACT

A freestanding electrical receptacle configured for being located on top of a surface of an object. The freestanding electrical receptacle includes a housing with a plurality of housing plates. Each housing plate of the plurality of housing plates has a respective thickness. The freestanding electrical receptacle also includes at least one receptacle located on the housing and at least one bottom plate coupled with the housing. The at least one bottom plate has a thickness which is thicker than the respective thickness of each housing plate of the plurality of housing plates for adding additional weight to the housing. The freestanding electrical receptacle also includes at least one bumper in engagement with the at least one bottom plate.

14 Claims, 4 Drawing Sheets

FREESTANDING ELECTRICAL RECEPTACLE

BACKGROUND OF THE INVENTION

1. Field of the Invention

The present invention relates to electrical receptacles, and, more particularly, to freestanding electrical receptacles.

2. Description of the Related Art

Electrical receptacles are needed to receive and distribute power. Typically, electrical receptacles are permanently fixed within a structure. For example, an electrical receptacle may be embedded within a wall of a building or a surface of a desk. In some instances, it may be desirable to have a freestanding or non-fixed electrical receptacle so that the user may (re)position the electrical receptacle in a more convenient location.

Generally, a freestanding electrical receptacle includes a housing, one or more receptacles, and a cable. The housing typically comprises multiple walls, e.g. metal and/or plastic plates, which form a rectangular enclosure. The bottom plate of the housing may be composed of a hard metal or plastic. As can be appreciated, such a bottom plate may damage or otherwise blemish the surface of the object upon which the electrical receptacle is placed. Additionally, the relatively low coefficient of friction of the hard metal or plastic bottom plate may enable the electrical receptacle to undesirably slide or otherwise move on the surface of the object.

What is needed in the art is an improved freestanding electrical receptacle.

SUMMARY OF THE INVENTION

The present invention provides a freestanding electrical receptacle. The freestanding electrical receptacle includes a housing, at least one bumper, and at least one bottom plate connected to the bumper. The bumper is configured for adhering the electrical receptacle to the surface of the subject. The bottom plate is configured for weighing down the electrical receptacle. Thereby, the base and bottom plates help to immobilize, or reduce the movement of, the electrical receptacle.

The invention in one form is directed to a freestanding electrical receptacle configured for being located on top of a surface of an object. The freestanding electrical receptacle includes a housing with a plurality of housing plates. Each housing plate of the plurality of housing plates has a respective thickness. The freestanding electrical receptacle also includes at least one receptacle located on the housing and at least one bottom plate coupled with the housing. The at least one bottom plate has a thickness which is thicker than the respective thickness of each housing plate of the plurality of housing plates for adding additional weight to the housing. The freestanding electrical receptacle also includes at least one bumper in engagement with the at least one bottom plate.

An advantage of the present invention is that the bumper of the electrical receptacle adheres or otherwise sticks onto the surface of the object so that the electrical receptacle is less likely to be undesirably moved.

Another advantage of the present invention is that the bottom plate of the electrical receptacle increases the weight of the electrical receptacle so that the electrical receptacle is less likely to be undesirably moved.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
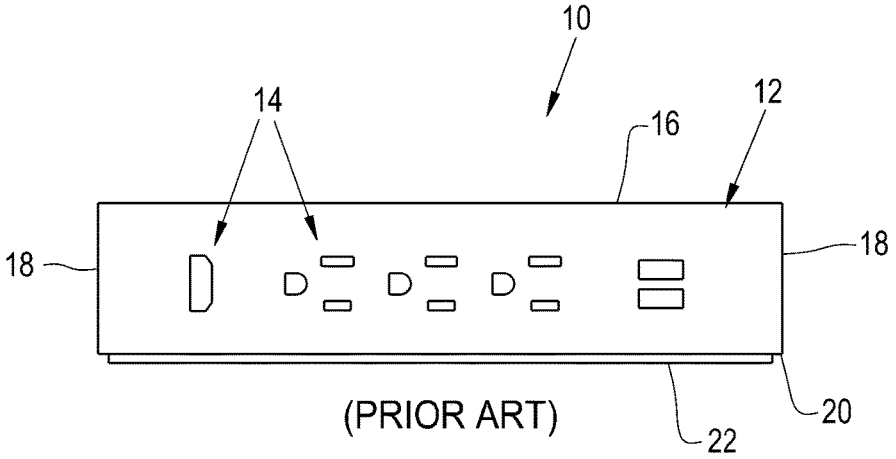
(PRIOR ART) FIG. 1
FIG. 1 is a front view of a known electrical receptacle.
Figure 2:
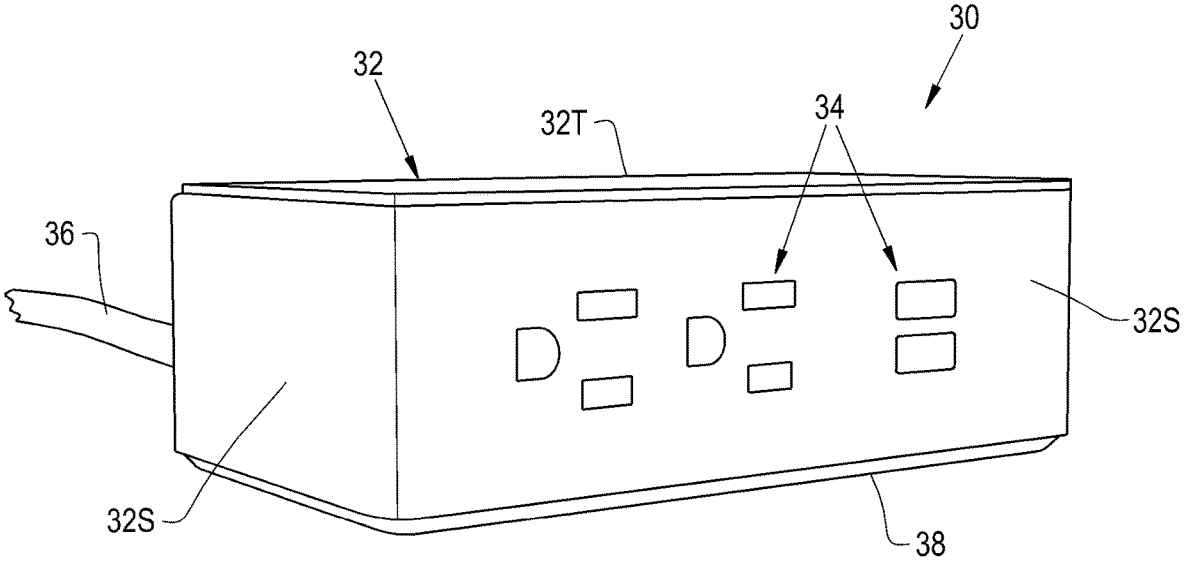
FIG. 2 is a front perspective view of an embodiment of a freestanding electrical receptacle, the electrical receptacle including a housing, a bumper, and a weighed member disposed within the bumper.

Referring now to the drawings, and more particularly to FIG. 1, there is shown a known electrical receptacle 10. The electrical receptacle 10 may be a fixed or freestanding electrical receptacle 10. The electrical receptacle 10 generally includes a housing 12 and receptacles 14. The housing 12 includes a top plate 16, side plates 18, a rear plate (not shown), and a base plate 20.

The electrical receptacle 10 also includes a bottom bracket or base 22 connected to the base plate 20 of the housing 12. The bracket 22 may mount the housing 12 onto a corresponding mounting member of an object. Additionally or alternatively, the bracket 22 may simply rest on top of a surface of an object; and thus, the bracket 22 may act as a base for the housing 12. The bracket 22 is typically in the form of an eleven-gauge steel plate 22. As can be appreciated, the bracket 22 will scratch or otherwise blemish the surface of the object upon which it rests. This issue of surface blemishing is exacerbated by the relatively low coefficient of friction of the bracket 22 which causes the electrical receptacle 10 to undesirably move across the surface of the object. Additionally, it may be toilsome to insert power cables into the receptacles 14 because the force of the power cables being inserted into the receptacles 14 may cause the electrical receptacle 10 to undesirably move rearwardly.

Referring now to the drawings, and more particularly to FIGS. 2-5, there is shown an embodiment of a freestanding electrical receptacle 30 according to the present invention. The electrical receptacle 30 may be positioned onto a surface of any desired object, for example a desk. The electrical receptacle 30 generally includes a housing 32, at least one receptacle 34, an electrical cable 36, at least one base member or bumper 38, at least one weighted member or bottom plate 40, and at least one fastener 42 for connecting the bumper(s) 38 and/or weighted bottom plate(s) 40 to the housing 32.

Even though the electrical receptacle 30 is freely movable relative to the surface upon which it rests, the electrical receptacle 30 is substantially immobilized due to the bumper (s) 38 and/or the bottom plate(s) 40. Hence, the electrical receptacle 30 is unlikely to undesirably move after it is manually positioned on the object. Additionally, the electrical receptacle 30 decreases the possibility of causing surface scratches on the object. As used herein, the term "freestanding" refers to a connection-free relationship between the electrical receptacle 30 and the surface upon which it rests. In other words, the electrical receptacle 30 is not fixedly connected to the surface upon which it rests such that the electrical receptacle 30 is freely movable by an individual.

The housing 32 may house any desired component, for example the electrical hardware of the electrical receptacle 30. The housing 32 may include multiple housing plates or wall members 32T, 32S, 32B. For example, the housing 32 may include a top plate 32T, one or more side plates 32S connected to the top plate 32T, and an optional bottom plate 32B connected to the side plates 32S. The housing 32 may not include a bottom plate 32B such that the bumper 38 and/or the bottom plate 40 defines the bottom of the housing 32. Alternatively, the housing 32 may be comprised of a single, monolithic member which defines the walls 32T, 32S, and/or 32B. The bumper 38 may sit directly against the bottom wall of the housing 32. The housing 32 may comprise any desired material, such as plastic and/or metal. The housing 32 may have a density of 0.1 $lb/in^3$.

The one or more receptacles 34 may be located on the front member of the housing 32. Each receptacle 34 may be in the form of any desired receptacle, such as a two-prong receptacle, a three-prong receptacle, a USB charging receptacle, etc.

The electrical cable 36 may be connected to the housing 32. The electrical cable 36 may be in the form of any desired power chord for providing electrical power to the housing 32.

The one or more bumpers 38 are configured for contacting and adhering to the surface of the object. The one or more bumpers 38 may be in engagement with the bottom plate 40. For instance, the one or more bumpers 38 may be coupled to the one or more bottom plates 40 for substantially surrounding the perimeter of the one or more bottom plates 40. Additionally, the one or more bumpers 38 may be located next to and/or directly connected to the underside of the housing 32. However, it should be appreciated that the one or more bumpers 38 may not be directly connected to the housing 32. As shown, the electrical receptacle 30 includes one bumper 38. However, the electrical receptacle 30 may include two, three, or more bumpers 38.

Figure 3:
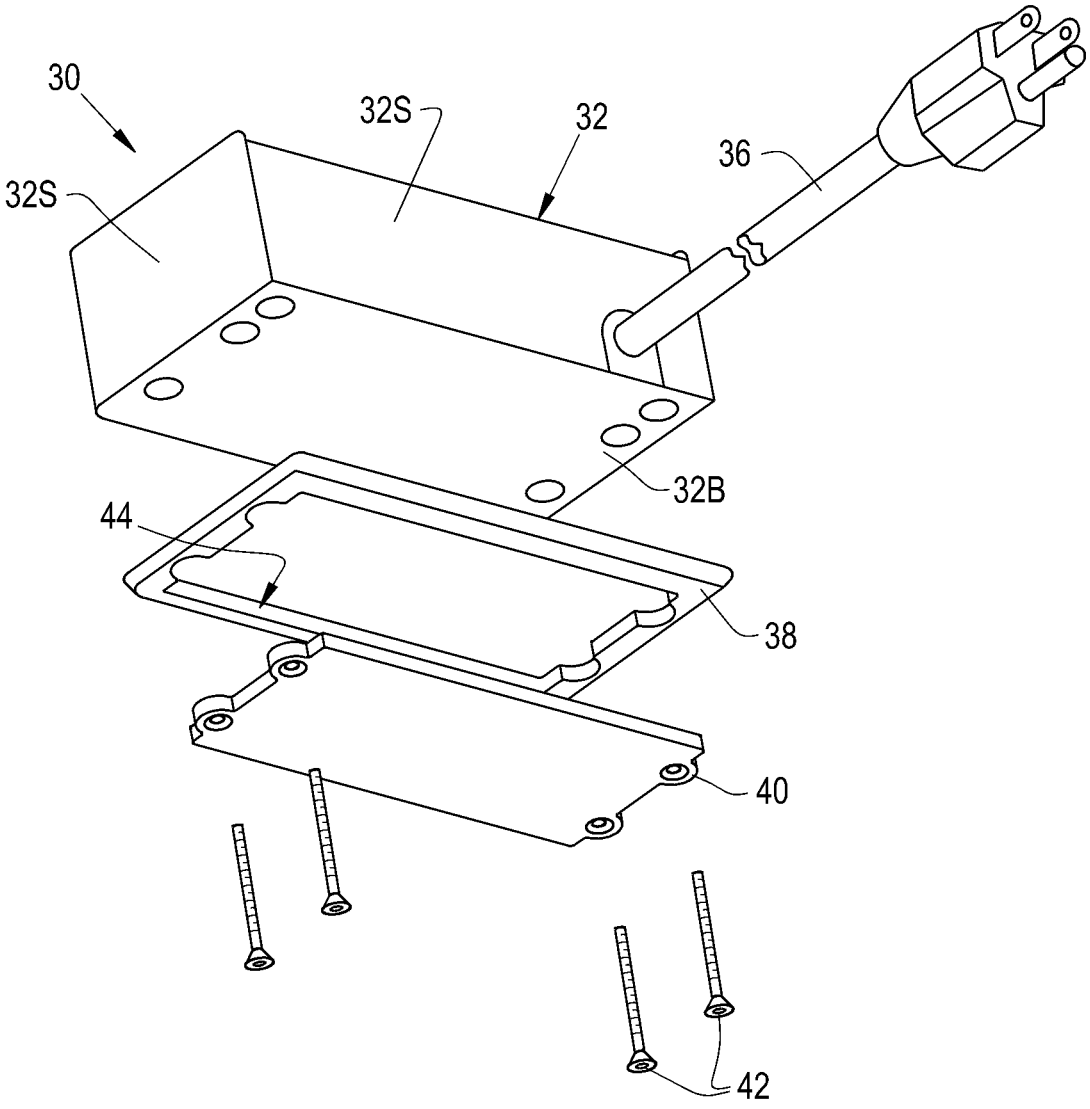
FIG. 3 is an exploded view of the electrical receptacle of FIG. 2.
Figure 4:
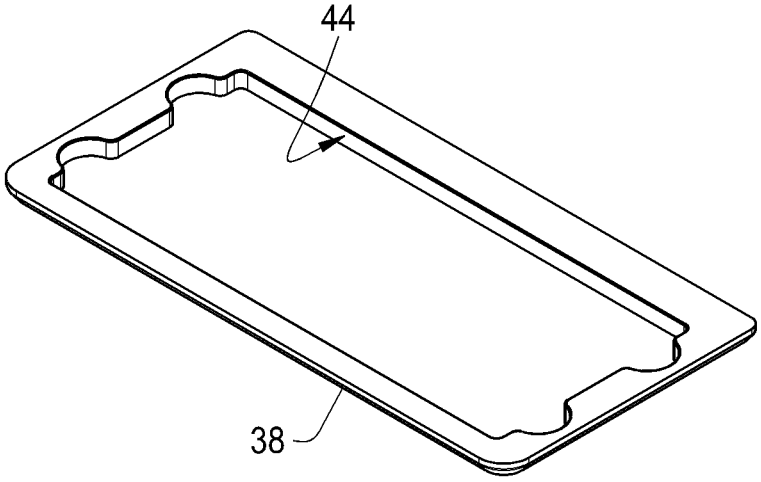
FIG. 4 is a perspective view of the bumper of the electrical receptacle of FIGS. 2-3.

Each bumper 38 has a cutout 44 with a shape which corresponds to the shape of a respective bottom plate 40 (FIGS. 3-4). Therein, each respective bottom plate 40 is seated within the cutout 44 of the bumper 38. In other words, the bumper 38 may wrap around the perimeter of the bottom plate 40. Each bumper 38 includes a front section, a pair of side sections connected to the front section, and a rear section connected to the pair of side sections. The width of the rear section may be greater than the width of the front section (FIG. 4). Thereby, with a thicker rear section that provides augmented friction at the rear of the electrical receptacle 30, there is a lower probability of movement of the electrical receptacle 30 when a user inserts a power cord of a device into the electrical receptacle 30.

Each bumper 38 may comprise a soft and/or tacky plastic material. For example, each bumper 38 may provide a soft, sticky, or tacky surface for adhering or gripping to the object upon which the electrical receptacle 30 rests. Thereby, the material of the bumper 38 has a greater coefficient of friction compared to a traditional bottom wall 20 or bracket 22 of a typical housing 12. Hence, due to the material of the bumper 38, the electrical receptacle 30 does not undesirably move. For instance, the electrical receptacle 30 may not be movable unless it is lifted or disengaged from the object by an individual. Each bumper 38 may be comprised of a plastic polymer, such as rubber, a thermoplastic elastomer (TPE) polymer, a thermoplastic polyurethane (TPU) polymer, or a silicon based material. As used herein, the term "adhere" describes how the bumper 38 contacts and engages with the object such that the electrical receptacle 30 does not move as much as a traditional electrical receptacle 10.

Figure 5:
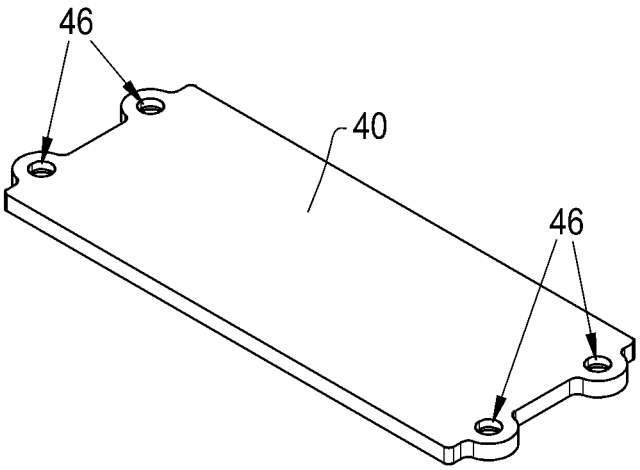
FIG. 5 is a perspective view of the bottom plate of the electrical receptacle of FIGS. 2-3.

The one or more bottom plates 40 are configured for adding additional weight to the weight of the housing 32. Each bottom plate 40 may be coupled with the housing 32. For example, each bottom plate 40 may be coupled with the housing via being directly connected to the housing 32. Alternatively, for example, each bottom plate 40 may be indirectly connected to the housing 32 by being connected to the one or more bumpers 38 which in turn are connected to the housing 32. Furthermore, each bottom plate 40 can be positioned within each bumper 38. Each bottom plate 40 can be seated within and be flush with a respective bumper 38. As shown, the electrical receptacle 30 includes one bottom plate 40 that is located within a respective bumper 38. However, the electrical receptacle 30 may include two, three, or more bottom plates 40 of matching or differing sizes. For instance, two or more bottom plates 40 may be located within a single bumper 38. Each bottom plate 40 includes at least one through-hole 46 for receiving the at least one fastener 42 therethrough (FIG. 5).

Each individual bottom plate 40, or the collective weight of multiple bottom plates 40, may be heavier than the bumper 38 and/or any or all members, e.g. plates 32T, 32S, 32B, of the housing 32. For example, each bottom plate 40 may be thicker than the plates 32T, 32S, 32B of the housing 32. Additionally, the material of each bottom plate 40 may have a greater density than the material of the bumper 38 and/or the material(s) of the housing 32. Thereby, additional weight is added to the bottom of the housing 32 by the bottom plate(s) 40 so that the electrical receptacle 30 is substantially immobilized or at least less likely to be undesirably moved. Each bottom plate 40 may comprise a metallic or plastic material. For example, each bottom plate 40 may include a heavy steel or alloy or even a heavy plastic compound with a specific gravity of 1.5 or greater. Additionally, for example, each bottom plate 40 may be in the form of a nine-gauge or heavier metal plate. Each bottom plate 40 may be composed of metals with high density allows that are greater than carbon steels. Each bottom plate 40 may also be composed of a compound of high density polymeric molded plastics. The bottom plate 40 may be thicker and/or have a greater density than a bottom wall or a bracket 22 of a typical housing 12 and/or any portion of the housing 32. For example, the bottom plate 40 may be approximately 20% heavier than a bottom wall or a bracket of a typical housing 12, plus or minus 10%. Additionally, for example, the bottom plate 40 may have a density of 0.284 $lb/in^3$ or greater. Furthermore, for example, the bottom plate 40 may have a thickness of an eighth of an inch or greater.

Thereby, the bottom plate 40 can be approximately 40% thicker than a bottom wall or a bracket of a typical housing 12, plus or minus 10%.

The at least one fastener 42 may jointly fasten the one or more bumpers 38 and bottom plates 40 to the underside of the housing 32. The electrical receptacle 30 may include four fasteners 42 that extend through the corresponding holes 46 of the bottom plate 40 in order to affix the bumper 38 and bottom plate 40 to the underside of the housing 32. Alternatively, the electrical receptacle 30 may include multiple fasteners 42 for separately attaching the bumper 38 and the bottom plate 40 to the housing 32, respectively. Each fastener 42 may be in the form of any desired fastener, such as a screw, bolt, anchor, clip, etc.

It should be appreciated that the electrical receptacle 30 may not include one or more fasteners 42 for connecting the members 38, 40 to the housing 32. For instance, the bottom plate 40 may be snap-fitted within the bumper 38. Additionally, for instance, the bumper 38 and/or the bottom plate 40 may include one or more protrusions or locking features which engage with respective mating features on the housing 32 in order to affix the members 38, 40 to the housing 32.

Figure 6:
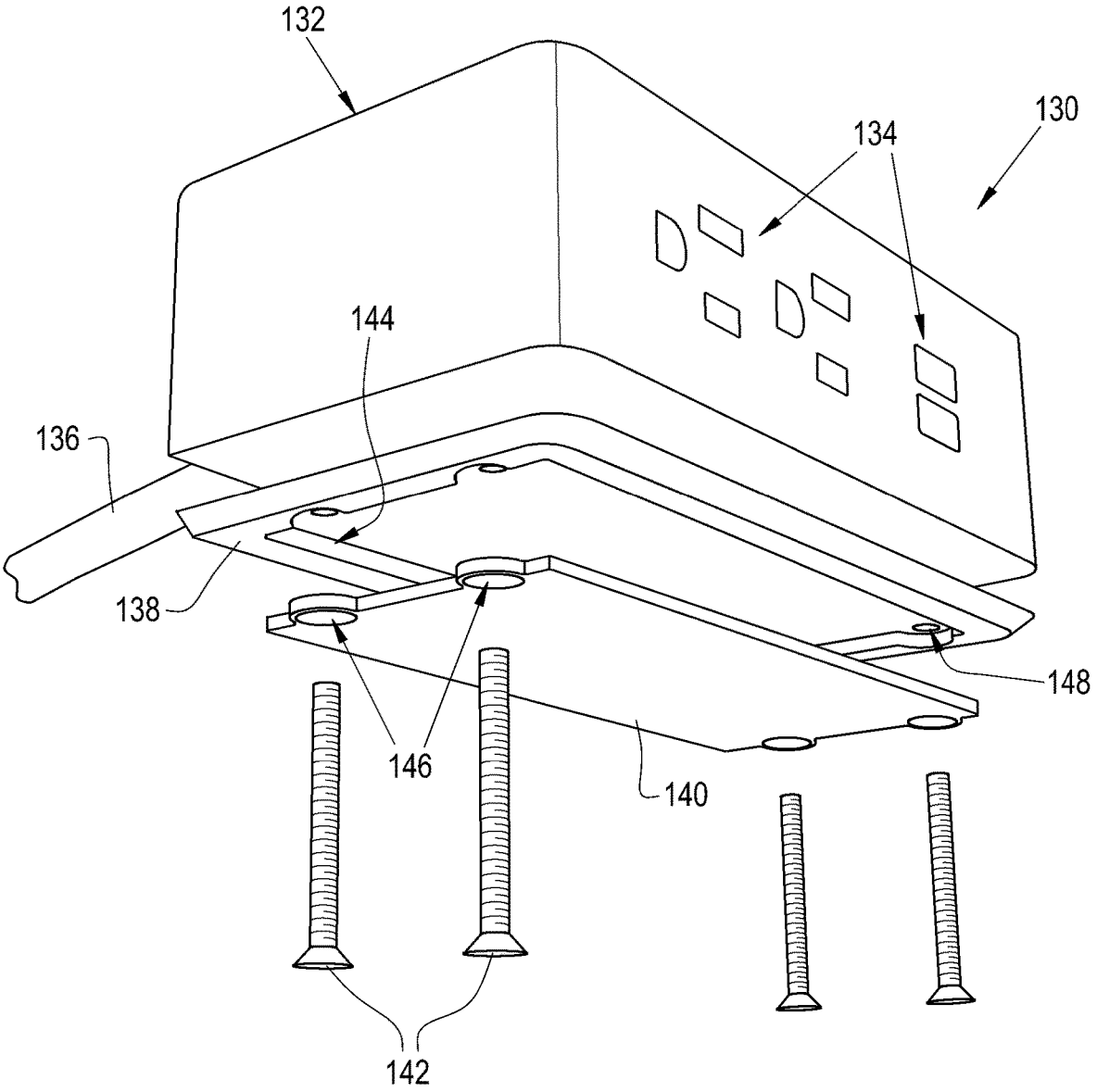
FIG. 6 is an exploded view of another embodiment of a freestanding electrical receptacle, the electrical receptacle including a housing, a recessed bumper, and a bottom plate disposed within the recessed bumper.

Referring now to FIG. 6, there is shown another embodiment of a freestanding electrical receptacle 130. The electrical receptacle 130 is substantially similar to the electrical receptacle 30, as described above, except that the bumper 138 has a recessed portion 144 with through-holes 148 instead of a cutout 44. Thereby, the bottom plate 144 can be seated within the recessed portion 144 of the bumper 138. The bumper 138 may be considered a webbed or closed bumper 138. The depth of the recessed portion 144 may be approximately 25-30% of the overall thickness of the bumper 138, plus or minus 10%. Like elements have been identified with like reference characters except for the 100 series designation.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A freestanding electrical receptacle configured for being located on top of a surface of an object, comprising:

a housing including a plurality of housing plates, each housing plate of the plurality of housing plates having a respective thickness;

at least one receptacle located on the housing;

at least one bottom plate coupled with the housing, the at least one bottom plate having a thickness which is thicker than the respective thickness of each housing plate of the plurality of housing plates for adding additional weight to the housing;

at least one bumper in engagement with the at least one bottom plate; and at least one fastener configured for connecting at least one of the at least one bumper and the at least one bottom plate to the housing.

2. The freestanding electrical receptacle of claim 1, wherein each housing plate of the plurality of housing plates has a respective density, wherein the at least one bottom plate has a density which is greater than the respective density of each housing plate of the plurality of housing plates for adding additional weight to the housing.

3. The freestanding electrical receptacle of claim 1, wherein the at least one bumper has a density, wherein the at least one bottom plate has a density which is greater than the density of the at least one bumper.

4. The freestanding electrical receptacle of claim 1, wherein the at least one bottom plate has a shape, wherein the at least one bumper has at least one cutout with a shape which corresponds to the shape of the at least one bottom plate such that the at least one bottom plate is seated within the at least one cutout of the at least one bumper.

5. The freestanding electrical receptacle of claim 1, wherein the at least one bottom plate has a shape, wherein the at least one bumper has at least one recessed portion with a shape which corresponds to the shape of the at least one bottom plate such that the at least one bottom plate is seated within the at least one recessed portion of the at least one bumper.

6. The freestanding electrical receptacle of claim 1, wherein the at least one bottom plate includes at least one through-hole for receiving the at least one fastener therethrough.

7. The freestanding electrical receptacle of claim 1, wherein the at least one bumper includes at least one through-hole for receiving the at least one fastener therethrough.

8. The freestanding electrical receptacle of claim 1, wherein the at least one bottom plate comprises one of a metallic material and a plastic material.

9. The freestanding electrical receptacle of claim 1, wherein the at least one bottom plate comprises a nine-gauge steel plate.

10. The freestanding electrical receptacle of claim 1, wherein the at least one bumper includes a front section, a pair of side sections connected to the front section, and a rear section connected to the pair of side sections, the front section having a width, the rear section having a width which is greater than the width of the front section.

11. The freestanding electrical receptacle of claim 1, wherein the at least one bumper is connected to the housing.

12. The freestanding electrical receptacle of claim 11, wherein the at least one bottom plate is positioned within the at least one bumper.

13. The freestanding electrical receptacle of claim 1, wherein the at least one bumper is configured for contacting and adhering to the surface of the object.

14. The freestanding electrical receptacle of claim 13, wherein the at least one bumper comprises a soft plastic material.

* * * * *